US005197164A

United States Patent [19]

Meier

[11] Patent Number: 5,197,164

[45] Date of Patent: Mar. 30, 1993

[54] QUICK RELEASE STRAP CONNECTOR

[75] Inventor: Terrence P. Meier, Naperville, Ill.

[73] Assignee: Illinois Tool Works Inc., Glenview, Ill.

[21] Appl. No.: 891,820

[22] Filed: Jun. 1, 1992

[51] Int. Cl.[5] ..... B65D 63/00

[52] U.S. Cl. ..... 24/16 PB; 24/17 AP

[58] Field of Search ..... 24/16 PB, 16 R, 17 AP, 24/17 A, 265 WS, 3 M, 3 K, 306, 300, 30.5 P, 598.1

[56] References Cited

U.S. PATENT DOCUMENTS

| | | | |
|---|---|---|---|
| 2,359,148 | 9/1944 | Partridge | 24/17 AP |
| 3,049,778 | 8/1962 | Weckesser | 24/16 PB |
| 3,475,716 | 10/1969 | Laig | 24/16 PB |
| 3,837,101 | 9/1974 | Young | 24/17 AP |
| 4,924,557 | 5/1990 | Heckerman et al. | 24/17 AP |

FOREIGN PATENT DOCUMENTS

| | | | |
|---|---|---|---|
| 1080617 | 12/1954 | France | 24/16 PB |
| 1126581 | 2/1959 | France | 24/16 PB |
| 1417124 | 10/1965 | France | 24/16 PB |
| 2097053 | 10/1982 | United Kingdom | 24/16 PB |

*Primary Examiner*—Victor N. Sakran
*Attorney, Agent, or Firm*—Schwartz & Weinrieb

[57] ABSTRACT

A quick release connector including an elongate strap member having first and second ends, a first aperture formed through the first end of the strap member having a predetermined configuration, a second aperture formed through the strap member between the first and second ends and at a predetermined distance away from the first end of the strap member, a first engagement member connected to the strap member proximate the second aperture for releasable locking engagement with the first aperture upon insertion of the first end of the strap member through the second aperture, and a second engagement member connected to the strap member proximate the second aperture for releasable locking engagement with the first aperture upon insertion of the first end of the strap member through the second aperture.

14 Claims, 2 Drawing Sheets

Fig. 4
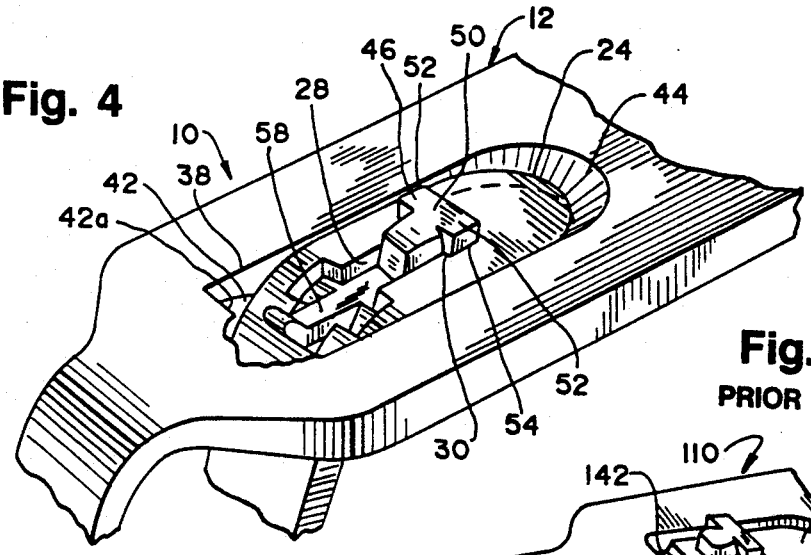
Fig. 8
PRIOR ART
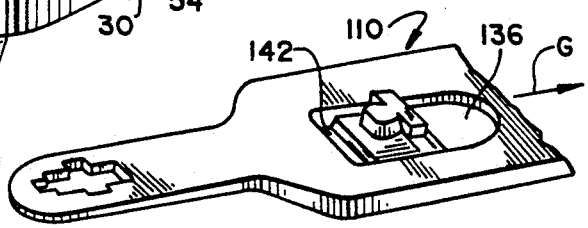
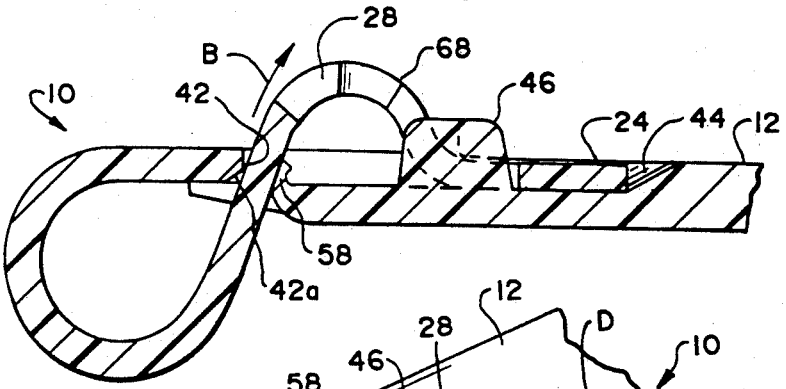
Fig. 5
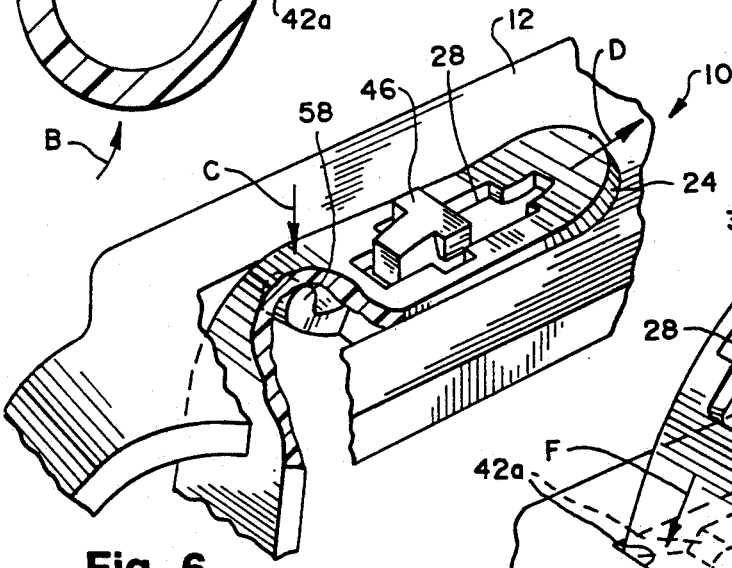
Fig. 6
Fig. 7
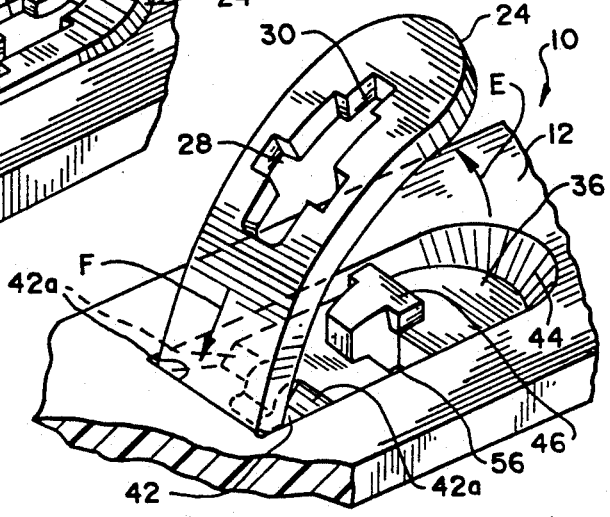

QUICK RELEASE STRAP CONNECTOR

BACKGROUND OF THE INVENTION

1. Field of the Invention

This invention relates generally to quick release connectors, and more particularly to a quick release connector which readily attaches a free end of a strap or web to another article and quickly can be removed by a user.

2. Description of the Related Art

Connectors frequently are utilized for releasably attaching the free end of a strap or web to another article, such as a shoulder or carrying strap to a camera, pair of binoculars, portable radio/cassette player or the like. Typically, the strap is securely fastened to one side of the connector and the connector is attached to a portion of the article.

An example of such a connector is disclosed in U.S. Pat. No. 4,924,557 and includes a harness having a carrying strap and a connector. The connector is formed from a resilient material in the form of a strap with an aperture and cooperating slot on a distal end thereof which receive a domed nipple and stem formed on an opposite end triangular portion so that the strap can be folded over itself with the nipple and stem forced into the aperture and slot thus forming a loop for attachment to an article. A plurality of walls are included formed on the triangular portion to maintain the distal end of the strap locked in the looped position. Such a connector, however, is difficult to manipulate due to the positioning of the walls proximate to the stem, provides no strain relief for the strap and readily can fail since it relies on the strength of the relatively narrow stem to provide the connection.

Another connector is illustrated in FIG. 8 which includes an aperture on the distal end formed in the shape of a cross for cooperative engagement with a complementary T-shaped bar formed on another portion of the connector. In use, the distal end is looped around a portion of an article and inserted through a second aperture formed proximate the T-shaped bar. The cross-shaped aperture then is inserted over the T-shaped bar and the distal end is slid into a locking cavity formed on the surface of the connector. Such a connector, however, can be susceptible to inadvertent disengagement during use and sometimes is difficult to manipulate.

It therefore is desirable to provide a quick release connector for attaching the free end of a strap to another article which is easy to manipulate, provides strain relief to the connector when under load and provides a connecting member having a sturdy, locking mechanism.

SUMMARY OF THE INVENTION

The invention provides a quick release connector including an elongate strap member having first and second ends. A first aperture is formed through the first end of the strap member having a predetermined configuration. A second aperture is formed through the strap member between the first and second ends and at a predetermined distance away from the first end of the strap member. A first engagement member is connected to the strap member proximate the second aperture for releasable locking engagement with the first aperture upon insertion of the first end of the strap member through the second aperture. A second engagement member also is connected to the strap member proximate the second aperture for releasable locking engagement with the first aperture upon insertion of the first end of the strap member through the second aperture.

BRIEF DESCRIPTION OF THE DRAWINGS

Various other objects, features, and attendant advantages of the present invention will become more fully appreciated from the following detailed description when considered in connection with the accompanying drawings, in which like reference characters designate like or corresponding parts throughout the several views, and wherein:

FIG. 4 is an enlarged perspective view of a portion of the connector, similar to FIGS. 2 and 3, illustrating a final locking engagement position of the connector;

FIG. 5 is a longitudinal sectional view of a portion of the connector of the invention illustrating an initial disengagement position;

FIG. 6 is an enlarged perspective view of a portion of the connector of the invention illustrating an intermediate disengagement position;

FIG. 7 is an enlarged perspective view of a portion of the connector of the invention illustrating a final disengagement position; and FIG. 8 is an enlarged perspective view of a portion of a prior art connector in its fully open position.

DESCRIPTION OF THE PREFERRED EMBODIMENT

Figure 1:
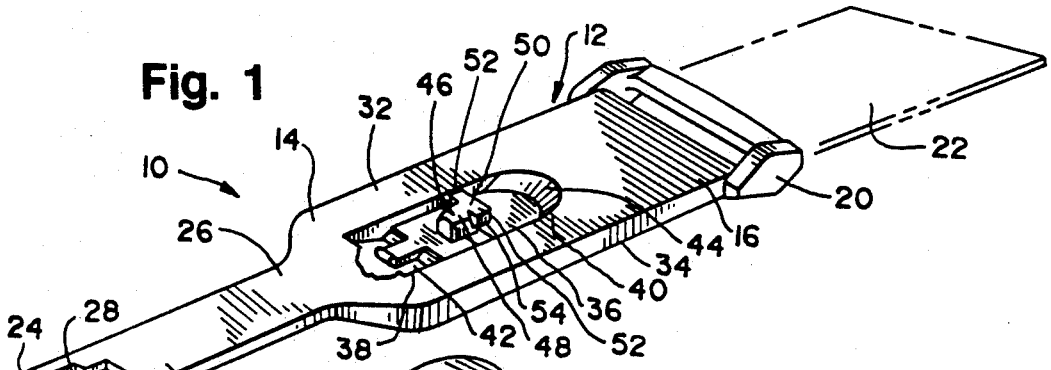
FIG. 1 is a perspective view of the quick connector of the invention in its fully open position and illustrated in conjunction with a buckle and a free end of a strap.

Referring to FIG. 1, the quick release connector of the invention is designated generally by the reference numeral 10. The connector 10 is formed as an elongate strap member having a rectangular body portion 12 having first and second opposite longitudinal ends 14 and 16, respectively, and an elongate strap portion 18 extending outwardly away from the first end 14. Preferably, the connector 10 is formed from flexible plastic as a single unitary member, but the particular material, size, shape and number of components can vary.

Typically, the second end 16 of the connector 10 is secured or formed in one piece with a buckle member 20 to which a web or strap 22 is attached. It is to be understood, however, that the connector 10 can be utilized in a variety of different applications with or without the buckle 20 and strap 22, if desired.

Figure 2:
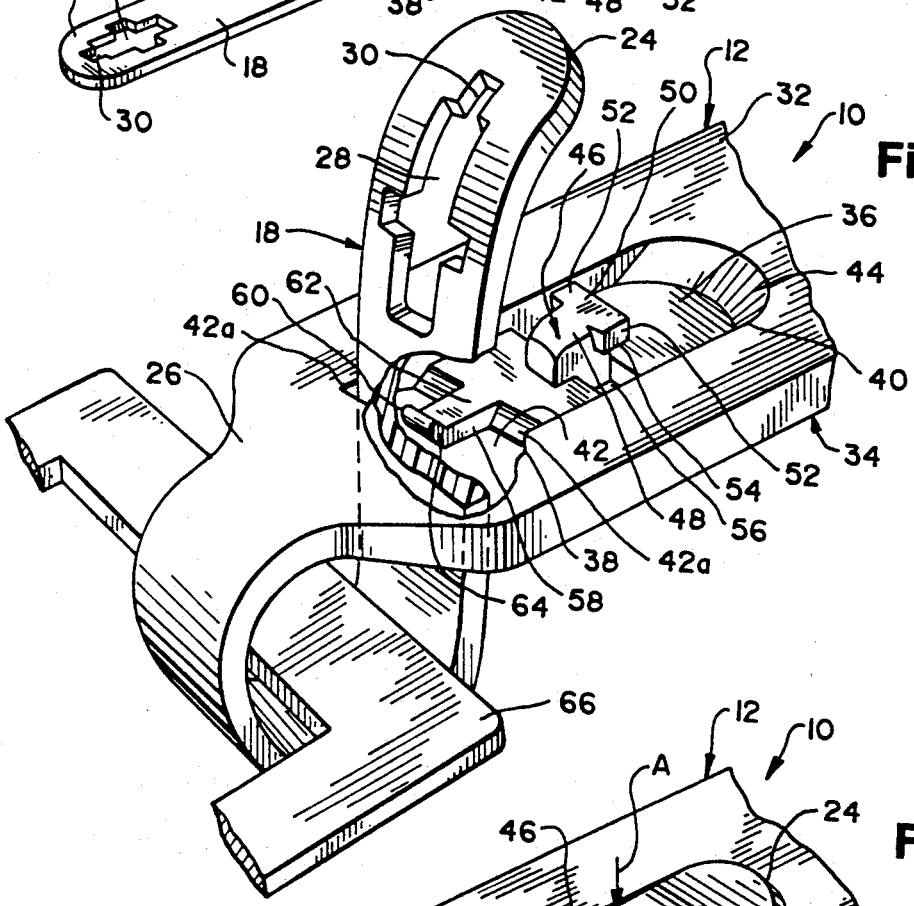
FIG. 2 is an enlarged perspective view of a portion of the connector of FIG. 1 with a portion cut away illustrating a preliminary attachment position to an article.

As FIGS. 1 and 2 illustrate, the elongate strap portion 18 includes a first distal end 24 and a second opposite proximal end 26 which is integrally formed with the first end 14 of the body portion 12. The first distal end 24 includes a first aperture 28 which is formed substantially in the shape of a "cross" or "plus sign". The end of the aperture 28 proximate the first distal end 24 is elongated to include an enlarged slot 30. The strap portion 18 can be formed in a variety of lengths and preferably is slightly thinner and narrower than the body portion 12 to assist in flexing of the strap portion 18 as will be described hereinafter.

The body portion 12 includes a top surface or side 32 and a bottom surface or side 34 and a substantially rectangular recess 36 formed on the top surface 32 proximate the first end 14 of the body portion 12. The recess 36 has a predetermined depth and includes a first end 38 and a second end 40 with a slotted aperture 42 formed at the first end 38 and extending through the body portion 12. To assist in insertion of the strap portion 18 through the slotted aperture 42 as described below, the walls 42a of the slotted aperture 42 can be tapered. The second end 40 of the recess 36 is formed as an arcuate ramped surface 44 tapering outwardly away from the inside to the outside of the recess 36.

To engage the cross-shaped aperture 28 of the strap portion 18, the recess 36 includes a substantially T-shaped engagement bar, lug or projection 46 upstanding therefrom and extending outwardly away from and slightly above the top surface 32 of the body portion 12. The T-shaped bar 46 includes a stem 48 and a top cross member 50 having opposite outer ends 52. Each outer end 52 of the cross member 50 preferably is relieved underneath a bottom side 54 to provide the desired engagement of the connector 10 as described below. To provide the relieved portions during molding of the connector 10, a tool (not illustrated) is inserted from the bottom side 34 of the connector 10 and, when removed, apertures 56 extending through the recess 36 remain in the connector 10.

In order to provide further engagement of the distal end 24 of the strap portion 18, the slotted aperture 42 includes a stop tongue or engagement member 58. The stop tongue 58 includes a distal end 60 and a proximal end 62 which preferably is integrally formed with the recess 36 on the side of the slotted aperture 42 opposite the first end 38 of the recess 36. The stop tongue 58 is somewhat flexible and the distal end 60 protrudes a predetermined distance across the slotted aperture 42 to a position proximate the first end 38. To assist in insertion and resist removal of the strap portion 18, the distal end 60 of the stop tongue 58 includes an upturned edge or shoulder 64 extending into the recess 36 toward the top surface 32 of the connector 10.

Figure 3:
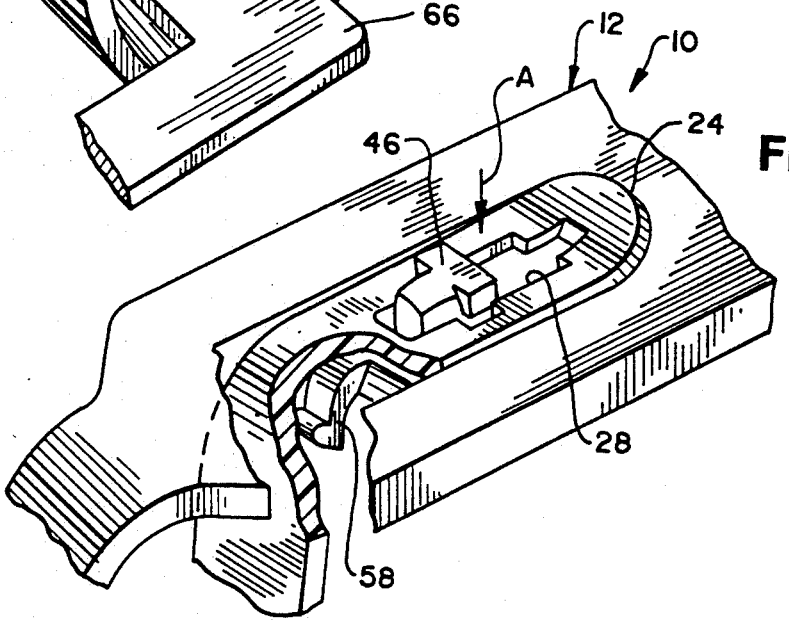
FIG. 3 is an enlarged perspective view of a portion of the connector, similar to FIG. 2, illustrating an initial locking engagement position of the connector.

As FIG. 2 illustrates, in operation the distal end 24 of the strap portion 18 is laced around a bar or ring 66, which is formed as part of an article such as a camera or the like, and is folded back toward the bottom surface 34 of the body portion 12 and through the slotted aperture 42 to the position illustrated in FIG. 2. Next, as FIG. 3 illustrates, the cross-shaped aperture 28 is inserted over the corresponding T-shaped bar 46 in the direction of arrow "A".

As FIG. 4 illustrates, the distal end 24 of the strap portion 18 then is pushed toward the first end 38 of the recess 36. This causes the stop tongue 58 to seat within the cross-shaped aperture 28. At the same time the enlarged slot 30 of the cross-shaped aperture 28 is seated about the stem 48 and slides under the bottom sides 54 of the outer ends 52 of the cross member 50 of the T-bar 46. Additionally, in this position the distal end 24 of the strap portion 18 seats within the bottom of the recess 36 at the base of the arcuate ramped end wall 44. In this final position, both the T-bar 46 and the stop tongue 58 cooperate with the cross-shaped aperture 28 to positively engage the strap portion 18 to the body portion 12 and prevent removal.

To disengage the connector 10, as FIG. 5 illustrates, the strap portion 18 first is pushed in the direction of arrows "B" to disengage the stop tongue 58 from the cross-shaped aperture 28 and form a bulge 68 in the strap portion 18 proximate the cross-shaped aperture 28. Next, as FIG. 6 illustrates, the bulge 68 is compressed or pushed in the direction of arrow "C" which forces the distal end 24 in the direction of arrow "D" and enables the distal end 24 to ride up the arcuate ramped portion 44 of the recess 36. At the same time, the arcuate ramped portion 44 of the recess 36 provides an upward lift to the strap portion 18 proximate the cross-shaped aperture 28 to assist in removing the cross-shaped aperture 28 from the T-bar 46 by providing a positive snap action to the strap portion 18. Finally, as FIG. 7 illustrates, the distal end 24 of the strap portion 18 is lifted away from the recess 36 in the direction of arrow "E" and the strap portion 18 is removed from the slotted aperture 42 in the direction of arrow "F" and is unthreaded from the bar 66.

FIG. 8 illustrates a prior art connector 110. The connector 110 does not include the stop tongue 58 and, as described above, is susceptible of being unintentionally disengaged by a force substantially along the line "G". Such a force causes the distal end 124 of the strap portion 118 to jump out of the recess 136 with the cross-shaped aperture 28 being disengaged from the T-bar 146. Additionally, the second end 40 of the recess 36 is formed without an arcuate ramped surface 44.

Modifications and variations of the present invention are possible in light of the above teachings. It is therefore to be understood that within the scope of the appended claims, the invention may be practiced otherwise than as specifically described.

What is claimed and desired to be secured by Letters Patent of the United States is:

1. A quick release connector, comprising:

an elongate strap member having first and second ends;

a first aperture formed through said first end of said strap member and having a predetermined configuration;

a second aperture formed through said strap member between said first and second ends and at a predetermined distance away from said first end of said strap member for insertably receiving said first end of said strap member;

first engagement means connected to said strap member proximate said second aperture for releasable locking engagement with said first aperture after insertion of said first end of said strap member through said second aperture along a first insertion direction and upon movement of said first end of said strap member through said second aperture along a second opposite direction; and second engagement means connected to said strap member and extending toward said second aperture for releasable locking engagement with said first aperture after insertion of said first end of said strap member through said second aperture along said first insertion direction and upon movement of said first end of said strap member through said second aperture along said second opposite direction.

2. The connector as defined in claim 1 wherein said first aperture includes first and second engagement portions for releasable engagement with said first and second engagement means, respectively.

3. The connector as set forth in claim 2, wherein:

said first aperture has a substantially t-shaped configuration, and said first and second engagement portions of said first aperture comprise opposite ends of said t-shaped aperture.

4. The connector as defined in claim 1 wherein said first engagement means is integrally formed with a first side of said strap member proximate said second aperture and said second engagement means is integrally formed with said strap member and extend a predetermined distance across said second aperture.

5. The connector as set forth in claim 4, wherein:

said second engagement means comprises a projecting tongue integrally formed with said strap member.

6. The connector as defined in claim 1 wherein said second end of said strap member includes means for connecting said second end to another article.

7. The connector as defined in claim 1 including release means for assisting in release of said first engagement means.

8. The connector as set forth in claim 7, further comprising:

recess means formed within an upper surface of said strap member within the vicinity of said first engagement means for housing said first end of said strap member after said first and second engagement means are engaged with said first aperture.

9. The connector as set forth in claim 8, wherein:

said means for assisting release of said first aperture from said first engagement means comprises an arcuate ramped portion of said recess means.

10. The connector as defined in claim 1 wherein said first and second engagement means simultaneously engage said first aperture.

11. The connector as set forth in claim 1, wherein:

said first engagement means comprises a substantially T-shaped lug projecting upwardly from an upper surface of said strap member.

12. The connector as set forth in claim 11, wherein:

said T-shaped lug comprises an upstanding stem portion and a cross member extending transversely across an upper end portion of said stem portion wherein said cross member has oppositely disposed outer end portions beneath which portions of said strap member are lockingly disposed after said T-shaped lug first engagement means is inserted through said first aperture.

13. The connector as set forth in claim 1, wherein:

said second engagement means comprises a projecting tongue integrally formed with said strap member within the vicinity of said second aperture.

14. The connector as set forth in claim 1, further comprising:

recess means formed within an upper surface of said strap member within the vicinity of said first engagement means for housing said first end of said strap member after said first and second engagement means are engaged with said first aperture.

* * * * *